US008511628B2

(12) United States Patent
Cox

(10) Patent No.: US 8,511,628 B2
(45) Date of Patent: Aug. 20, 2013

(54) ANCHOR POINT

(75) Inventor: Gerardus Antonie Martinus Maria Cox, SR Son (NL)

(73) Assignee: XSPlatforms Holding, BV, Gorinchem (NL)

( * ) Notice: Subject to any disclaimer, the term of this patent is extended or adjusted under 35 U.S.C. 154(b) by 323 days.

(21) Appl. No.: 12/415,475

(22) Filed: Mar. 31, 2009

(65) Prior Publication Data

US 2010/0243837 A1 Sep. 30, 2010

(51) Int. Cl.
*A47G 29/02* (2006.01)
*E04G 3/20* (2006.01)
*E06B 7/28* (2006.01)

(52) U.S. Cl.
USPC ..... 248/237; 248/636; 248/688

(58) Field of Classification Search
USPC ..... 248/688, 346.01, 346.03, 910, 310, 248/146, 188.1, 188.8, 636, 615, 562, 519, 248/523, 616, 518, 550, 237, 148, 536; 182/3, 182/45, 43; 52/12
See application file for complete search history.

(56) References Cited

U.S. PATENT DOCUMENTS

| | | | | |
|---|---|---|---|---|
| 6,027,086 | A * | 2/2000 | Heitlinger et al. | 248/188.5 |
| 6,113,054 | A * | 9/2000 | Ma | 248/523 |
| 6,405,991 | B1 * | 6/2002 | Damiano | 248/548 |
| 6,446,930 | B1 * | 9/2002 | Li | 248/519 |
| 6,868,647 | B2 * | 3/2005 | Poldmaa | 52/749.12 |
| 6,889,946 | B2 * | 5/2005 | Bizaj | 248/188.2 |
| 7,163,083 | B2 * | 1/2007 | Argoud | 182/113 |
| 7,744,050 | B2 * | 6/2010 | de Toledo et al. | 248/188.3 |
| 2010/0281791 | A1 * | 11/2010 | Intagliata et al. | 52/127.12 |

* cited by examiner

*Primary Examiner* — Nkeisha Smith

(57) ABSTRACT

An anchor point has a foot, an elongated absorbing element, and a coupling feature for attaching a coupling element to the means of absorbing energy. The elongated absorbing element is provided with plates which extend radially and are situated axially at a distance from each other, and a casing that is situated about the absorbing element and is attached to the foot at a first end and at the second end is connected to an end of the absorbing element in such a way that it can be detached. The absorbing element is attached to a safety device at the other end with which the absorbing element is secured to the casing to prevent twisting. The safety device is provided with a locking device for locking the pin in the absorbing element.

7 Claims, 4 Drawing Sheets

ANCHOR POINT

BACKGROUND OF THE INVENTION

1. Field of the Invention

The invention relates to an anchor point, in particular for anchoring a cable on the roof of a building, comprising a foot, as well as a means of absorbing energy that is connected to the foot and is provided with a coupling feature for attaching a coupling element to the means of absorbing energy. Workers on the roof of a building are fastened to a safety cable which in turn is fixed to an anchor point on the roof. Should a worker fall, the anchor point must absorb the fall as well as the fall's energy.

2. Prior Art

A prior art anchor point utilizes a cylinder with a piston. The friction of the piston moving within the cylinder functions to absorb the necessary energy. The force is absorbed in a linear manner, with the energy being absorbed as the piston moved a distance with respect to the cylinder.

SUMMARY OF THE INVENTION

An objective of the invention is to provide an anchor point of the type described in the preamble that is better than the known anchor point. To this end, the anchor point according to the invention is characterized in that the means of absorbing energy comprises an elongated absorbing element provided with plates that extend radially and are axially situated at a distance from each other. Energy absorption takes place here through the bending of the absorbing element and because when bending, the plates of the absorbing element slide over each other. The more the absorbing element bends the more the plates will come in contact and slide over each other. The energy absorbed per unit of time increases because of this and therefore one can speak of a progressive absorption of energy instead of linear as is the case with the known anchor point, as a result of which the energy is absorbed more evenly and a fall is also more evenly absorbed.

An embodiment of the anchor point according to the invention is characterized in that the means of absorbing energy, furthermore, comprises a casing that is situated about the absorbing element and is coupled to the foot at a first end and at the second end is coupled to an end of the absorbing element. The absorption of energy therefore also takes place through deformation of the casing when the absorbing element bends. Because of this, a slight bending of the absorbing element is directly visible on the outside because of the deformation of the cylinder Preferably, the casing is attached to the foot at the first end and at the other end is connected to the absorbing element in such a way that it can be detached.

Furthermore, the absorbing element is preferably provided with a screw thread at one end and the foot is provided with an additional screw thread that cooperates with this screw thread.

A further embodiment of the anchor point according to the invention is characterized in that the absorbing element is attached at the other end to a safety device with which the absorbing element is secured to the casing to prevent twisting. Because of this, the absorbing element is prevented from coming loose from the foot.

Still a further embodiment of the anchor point according to the invention is characterized in that the safety device is provided with a locking device for locking it. In this way, opening of the lock by unauthorized persons is prevented.

In order to facilitate attachment of the foot to a roof, the foot comprises a baseplate, which is thicker at its centre and has two aligned holes, one of which has a greater diameter than the other one and is provided with the additional screw thread.

BRIEF DESCRIPTION OF THE DRAWINGS

The invention will be elucidated more fully below on the basis of drawings in which embodiments of the anchor point according to the invention are shown. In these drawings.

DETAILED DESCRIPTION OF THE DRAWINGS

Figure 1:
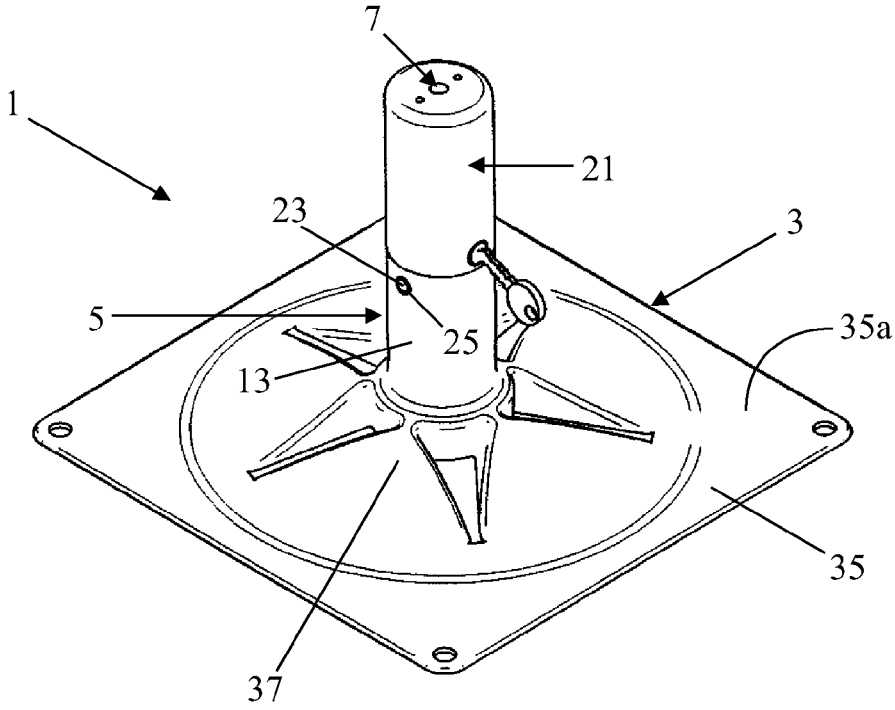
FIG. 1 shows a perspective view of the first embodiment of the anchor point according to the invention.
Figure 2:
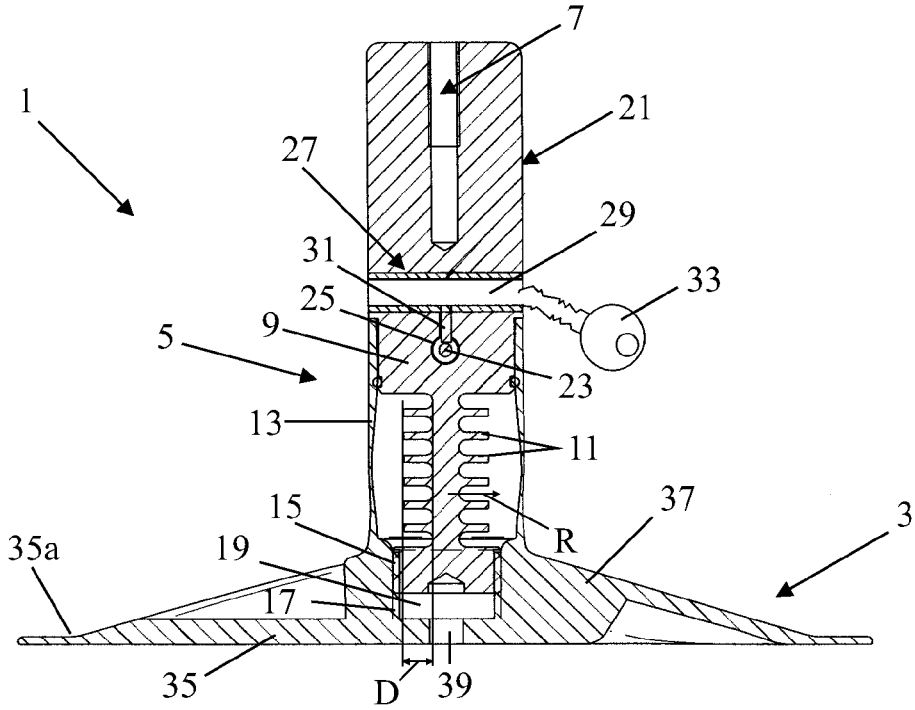
FIG. 2 shows a longitudinal section of the anchor point shown in FIG. 1.

In FIGS. 1 and 2, a perspective view and a longitudinal section of a first embodiment of the anchor point according to the invention is shown. The anchor point 1 has a foot 3, a means of absorbing energy 5 that is connected to the foot and is provided with a coupling feature 7 for attaching a coupling element to the means of absorbing energy. The coupling feature is a hole provided with an internal screw thread in which an eye provided with an outside screw thread can be screwed in.

The means of absorbing energy 5 is an elongated absorbing element 9 provided with plates 11 which extend radially and are axially situated at a distance from each other, and a casing 13 about the absorbing element that at a first end is attached to the foot and is connected at the second end to an end of the absorbing element 9 in such a way that it can be detached. The casing 13 is smaller at its centre than at its ends.

The absorbing element 9 is provided with an outside screw thread 15 that cooperates with an internal screw thread 17 situated in a hole 19 in the foot 3. The absorbing element 9 is attached at the other end to a safety device 21 with which the absorbing element is secured to the casing 13 to prevent twisting. The safety device is a pin 23 that passes through a hole 25 in the casing 13 and the absorbing element 9.

The safety device 21 is provided with a locking device 27 for locking the pin 23 in the absorbing element 9. The locking device 27 has a cylinder lock 29 that can move a blocking peg 31 between a blocking position in which it passes through a hole in the pin 23 and an open position in which it has been removed from the opening. The cylinder lock 29 can be operated by a key 33.

The foot 3 is a baseplate 35 that is thicker at its centre 37. There are two aligned holes 19, 39 situated in the thicker part, of which the hole 19 has a greater diameter than the other hole 39 and is provided with an internal screw thread 17. The hole 39, when the anchor point is mounted on the roof of a building, is placed over a threaded stud fitted in the roof, after which the baseplate is screwed tight to the roof with a nut. The thicker part 37 is on the upper side 35*a* of the baseplate in this embodiment.

Figure 3:
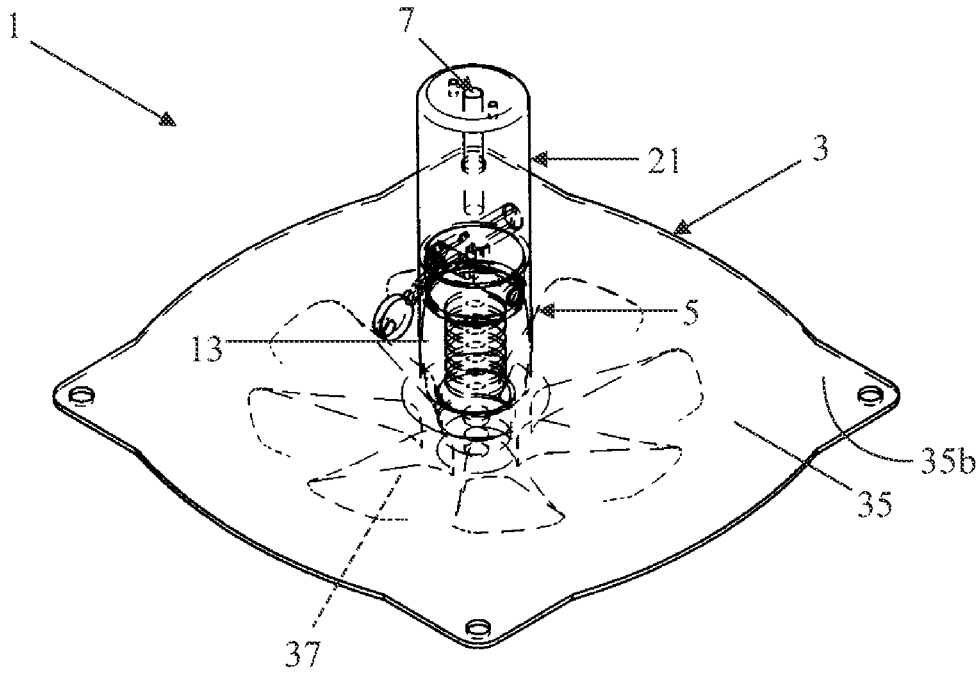
FIG. 3 shows a perspective view of the second embodiment of the anchor point according to the invention.
Figure 4:
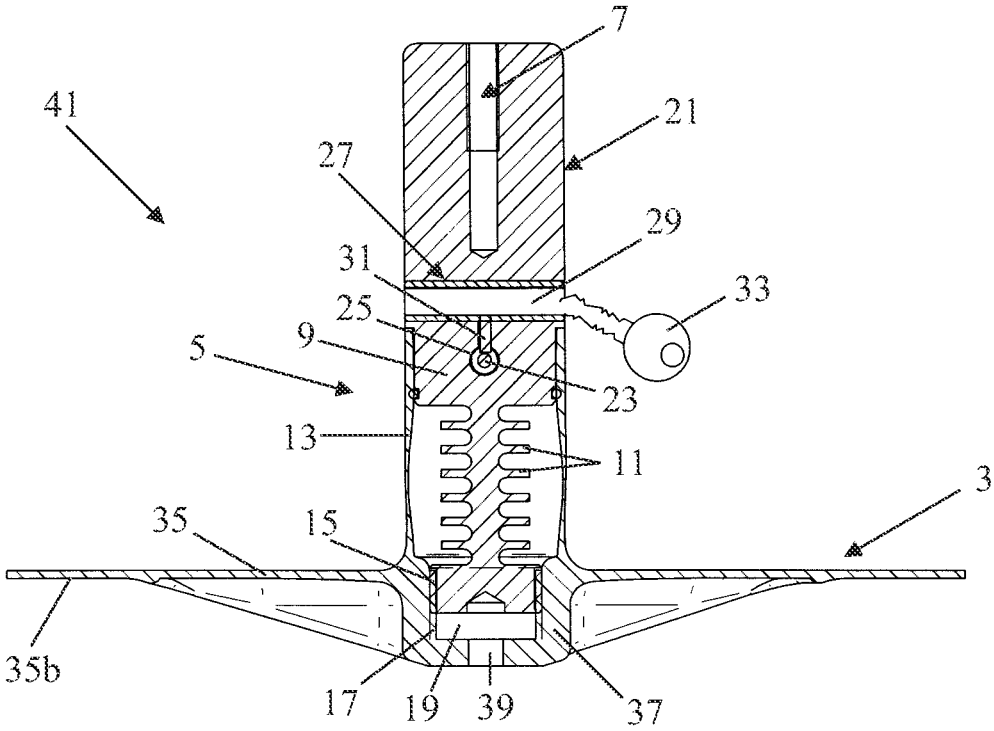
FIG. 4 shows a longitudinal section of the anchor point shown in FIG. 3.

In FIGS. 3 and 4 a perspective view and a longitudinal section of a second embodiment of the anchor point according to the invention are shown respectively. All parts that are the same as or have the same function as those of the first embodiment are indicated with the same reference numbers. With this anchor point 41 the thicker part 37 is on the lower side 35*b* of the baseplate instead of the upper side. Because of this, the foot 3 of the anchor point 41, after mounting on a roof, is fully sunk into the roof.

Figure 5:
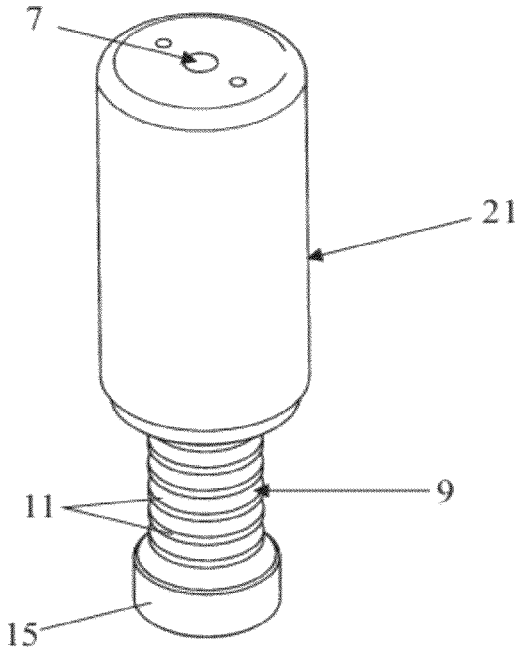
FIG. 5 shows a perspective view of the absorbing element with the safety device of the anchor points shown in FIGS. 1-4.
Figure 6:
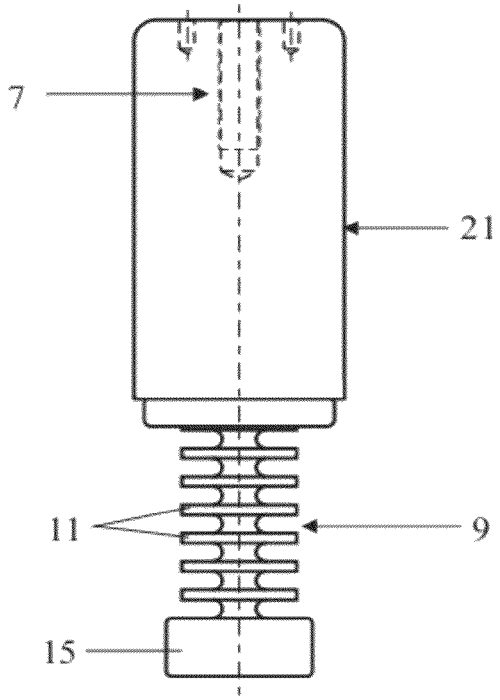
FIG. 6 shows a side elevation view of the absorbing element shown in FIG. 5.
Figure 8:
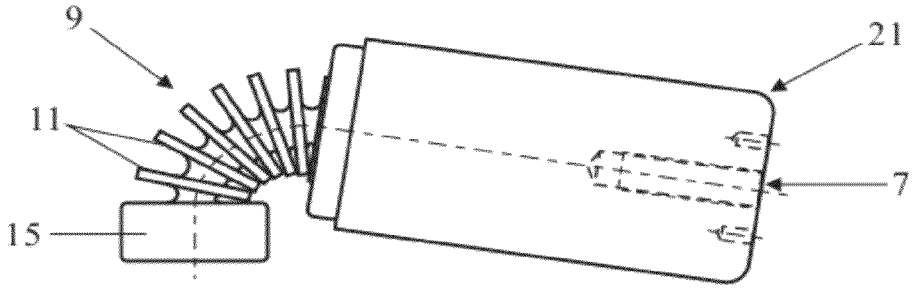
FIG. 8 shows the absorbing element in a further bended situation with the plates sliding over each other.

In FIGS. 5 and 6, by way of illustration, the absorbing element 9 with the safety device 21 of the anchor points 1 and 41 shown in FIGS. 1-4 is shown enlarged in a perspective view and a longitudinal section respectively. The absorbing element 9 with the safety device 21 is screwed into the foot after this has been mounted on the roof. After that an eye is screwed into the hole, which is the coupling feature 7, to which a safety cable can be coupled.

Although in the above the invention is explained on the basis of the drawings, it should be noted that the invention is in no way limited to the embodiments shown in the drawings. The invention also extends to all embodiments deviating from the embodiments shown in the drawings within the context defined by the claims.

Figure 7:
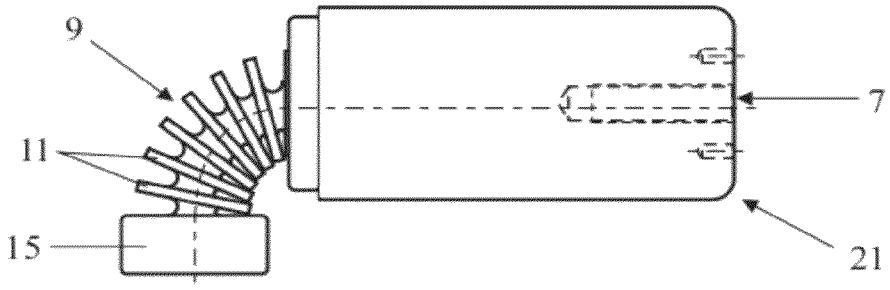
FIG. 7A is a side elevational view of the absorbing element illustrating plates that extend radially and are situated axially at a distance from each other.
FIG. 7B-7D are side elevational views of the absorbing element as it is bent further over, illustrating the plates of the absorbing element sliding over each other to absorb energy.
Figure 7A:
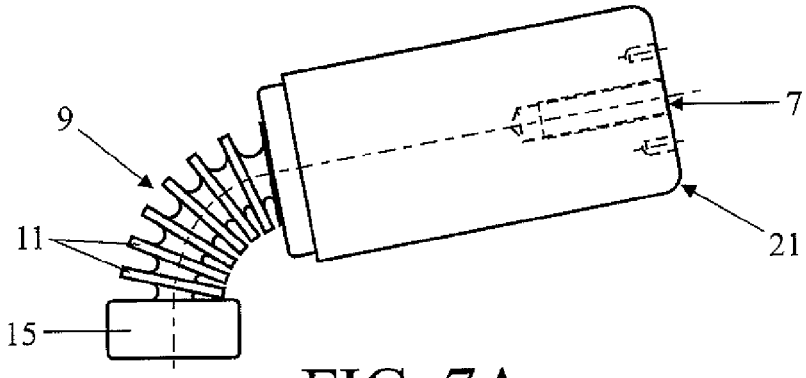
Figure 7B:
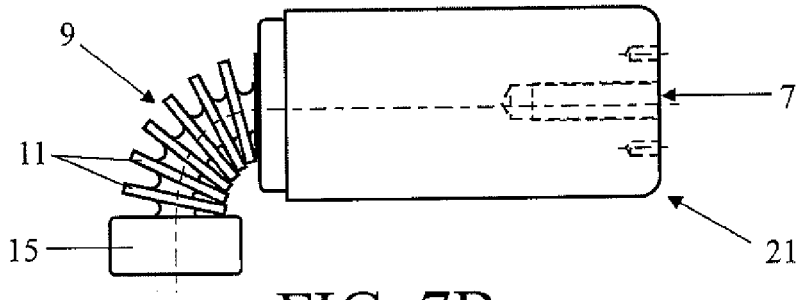
Figure 7C:
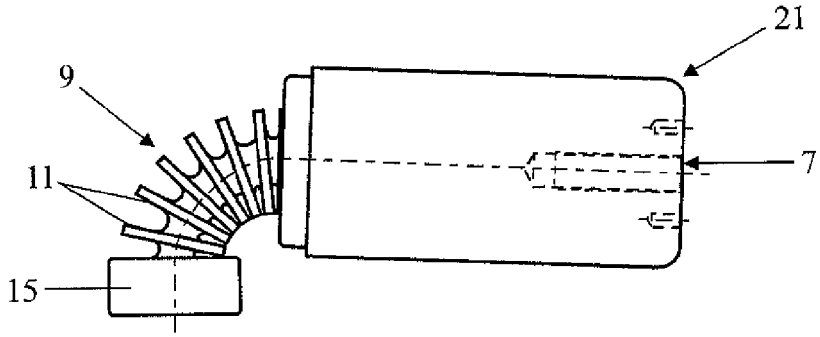
Figure 7D:
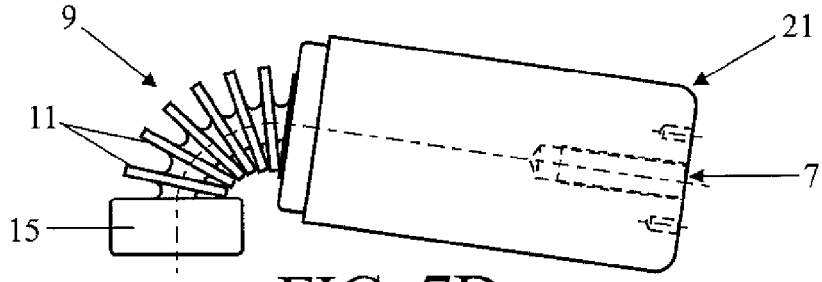

FIG. 7A is a side elevational view of the absorbing element 9 illustrating plates 11 that extend radially and are situated axially at a distance from each other. FIG. 7B-7D are side elevational views of the absorbing element 9 as it is bent further over, illustrating the plates 11 of the absorbing element sliding over each other to absorb energy.

What is claimed is:

1. An anchor point, in particular for anchoring a cable to a roof of a building, comprising:

a foot, as well as a means of absorbing energy that is connected to the foot and is provided with a coupling feature for attaching a coupling element to the means of absorbing energy, characterized in that the means of absorbing energy comprises an elongated absorbing element that is provided with plates which extend a distance radially and are situated axially at a distance from each other, in which the distance over which the plates radially extend is such that bending of the absorbing element causes the plates to slide over each other, wherein the means of absorbing energy further comprises a casing that is situated about the absorbing element and is coupled to the foot at a first end of the casing and a second end of the casing is coupled to an end of the absorbing element.

2. The anchor point according to claim 1, characterized in that the second end of the casing is attached to an end of the absorbing element in such a way that the casing can be detached from the absorbing element.

3. The anchor point according to claim 1, characterized in that the absorbing element is provided with a screw thread at one end of the absorbing element and that the foot is provided with an additional screw thread that cooperates with the screw thread of the absorbing element.

4. The anchor point according to claim 1, characterized in that the absorbing element is attached to the casing via a safety device to prevent twisting.

5. The anchor point according to claim 4, characterized in that the safety device is provided with a locking device for preventing twisting of the absorbing element.

6. The anchor point according to claim 1, characterized in that the foot comprises a baseplate, the baseplate being thicker at its centre and is provided with two aligned holes, one of which has a greater diameter than the other one and is provided with a screw thread.

7. An anchor point for anchoring a cable to a roof of a building, the anchor point comprising:

a foot having a baseplate that is adapted to be mounted on the roof;

an elongated absorbing element;

plates extending from the elongated absorbing element, the plates being axially spaced from each other and extending from the elongated absorbing element radially a distance such that bending the absorbing element causes the plates to slide over each other;

an outside screw thread of the elongated absorbing element that threadedly engages an internal screw thread of the foot; and a casing attached to the foot at a first end, and removably attached to the elongated absorbing element at a second end.

* * * * *